United States Patent [19]

Borror et al.

[11] Patent Number: 4,745,046

[45] Date of Patent: May 17, 1988

[54] THERMAL IMAGING METHOD

[75] Inventors: Alan L. Borror, Andover; Ernest W. Ellis, Carlisle, both of Mass.

[73] Assignee: Polaroid Corporation, Cambridge, Mass.

[21] Appl. No.: 861,376

[22] Filed: May 14, 1986

Related U.S. Application Data

[63] Continuation-in-part of Ser. No. 740,888, Jun. 3, 1985, abandoned.

[51] Int. Cl.[4] ..... G03C 1/72; G03C 7/00

[52] U.S. Cl. ..... 430/332; 430/333; 430/338; 430/138; 430/964; 430/945; 503/201; 503/217; 503/224; 503/204

[58] Field of Search ..... 430/338, 340, 955, 332, 430/333, 964, 945, 138; 428/913; 346/201, 217; 503/224, 204

[56] References Cited

U.S. PATENT DOCUMENTS

| | | | |
|---|---|---|---|
| 3,539,375 | 11/1970 | Baum | 428/913 |
| 3,598,583 | 8/1971 | Sprague | 430/333 |
| 4,345,017 | 8/1982 | Cournoyer et al. | 430/513 |
| 4,401,717 | 8/1983 | Ikeda et al. | 428/913 |
| 4,415,633 | 11/1983 | Nakamura et al. | 428/913 |
| 4,499,180 | 2/1985 | Hirai et al. | 430/619 |
| 4,500,897 | 2/1985 | Matsuda et al. | 346/217 |
| 4,521,793 | 6/1985 | Kabashima et al. | 346/224 |
| 4,529,992 | 7/1985 | Ishida et al. | 346/204 |

FOREIGN PATENT DOCUMENTS 55-87553 7/1980 Japan .

*Primary Examiner*—Won H. Louie

[57] ABSTRACT

A thermal imaging method is provided which employs as color-forming co-reactants, (a) a substantially colorless di- or triarylmethane compound possessing on the meso carbon atom within its triarylmethane structure an aryl group substituted in the ortho position with a nucleophilic moiety which is ring-closed on the meso carbon atom and (b) an electrophilic reagent which upon heating and contacting said di- or triarylmethane compound undergoes a bimolecular nucleophilic substitution reaction with the nucleophilic moiety to form a colored, ring-opened di- or triarylmethane compound.

16 Claims, No Drawings

THERMAL IMAGING METHOD

CROSS REFERENCE TO RELATED APPLICATION

This application is a continuation-in-part of copending application Ser. No. 740,888 filed June 3, 1985 abandoned.

BACKGROUND OF THE INVENTION

1. Field of the Invention

This invention relates to heat-sensitive recording elements for making color images and to a method of making color images using said elements.

2. Description of the Prior Art

A variety of thermal imaging systems for producing color images have been proposed. One system commonly employed for heat-sensitive recording materials comprises a two-component system utilizing a heat induced coloration reaction between an electron donating compound (color former) and an electron accepting compound (color developer). For producing dye images, the electron donating compound usually is a colorless electron donating dye comprising a triarylmethane, diphenylmethane, xanthene, thiazine or spiro compound, for example, Crystal Violet Lactone, N-halophenyl leuco Auramine, rhodamine B anilinolactam, 3-piperidino-6-methyl-7-anilinofluoran, benzoyl leuco Methylene blue, 3-methyl-spirodinaphthofuran, etc. The electron accepting compound is an acidic material usually, a phenol derivative or an aromatic carboxylic acid derivative, for example, p-tert-butylphenol, 2,2-bis (p-hydroxyphenyl)propane, 1,1-bis(p-hydroxyphenyl) pentane, p-hydroxybenzoic acid, 3,5-di-tert-butylsalicylic acid, etc. Such thermal imaging materials and various combinations thereof are now well known, and various methods of preparing heat-sensitive recording elements employing these materials also are well known and have been described, for example, in U.S. Pat. Nos. 3,539,375, 4,401,717 and 4,415,633.

Heat-sensitive recording materials employing two-component systems such as the foregoing ordinarily include a binder or some other means for physically separating the two components to prevent premature mixing and coloration and usually are prepared by dispersing the two components as fine particles in a binder and then coating this mixture on a support. Images are formed by applying heat to melt one or both of the components so that they will come into contact with each other to form color. Depending upon the colorless electron-donating dye, the coloration reaction initiated by contacting the melted component(s) may comprise dissociation or ring-opening in those compounds containing a cyclic ring-closing moiety as part of their structure. For example, color formers such as triarylmethane compounds possessing a lactone or lactam moiety ring-closed on the methane carbon atom become ring-opened and colored when contacted with the acidic electron accepting compound by an environmental reaction usually an ionization or hydrogen-bonding reaction.

SUMMARY OF THE INVENTION

The present invention is concerned with thermal imaging systems employing colorless di- or triarylmethane compounds that rely on a chemical reaction with a substantial activation energy to form a covalent bond for color formation rather than a diffusion controlled reaction such as an acid-base reaction. In accordance with the present invention, the colorless di- or triarylmethane compound possesses a cyclic moiety in its structure which is nucleophilic in character, and color is formed by contacting the di- or triarylmethane compound with an electrophilic reagent that undergoes a bimolecular nucleophilic substitution reaction with the nucleophilic moiety of the di- or triarylmethane compound to form a colored ring-opened compound which is a new compound different from said colorless di- or triarylmethane reactant. Since di- or triarylmethane compounds useful in the subject coloration reaction may be selected to provide a wide range of colors, including black, the thermal imaging systems of the present invention are not only useful in the production of monochromes and bichromes but also useful in the production of full color images. Moreover, by appropriate selection of the color-forming reactants, image formation may be carried out at moderately elevated temperatures above room temperatures employing any conventional means for effecting imagewise heating.

It is, therefore, the primary object of the present invention to provide a method of thermal imaging for producing color images.

It is another object of the present invention to provide heat-sensitive recording elements useful in said method.

Other objects of the invention will in part be obvious and will in part appear hereinafter.

The invention accordingly comprises the methods involving the several steps and the relation and order of one or more of such steps with respect to each of the others, and the products and compositions possessing the features, properties and the relation of elements which are exemplified in the following detailed disclosure, and the scope of the application of which will be indicated in the claims.

For a fuller understanding of the nature and objects of the invention, reference should be had to the following detailed description.

DESCRIPTION OF THE PREFERRED EMBODIMENT

As noted above, the present invention is concerned with thermal imaging systems which are useful in the production of both monochrome and multicolor images. The colorless di- or triarylmethane compound and the electrophilic reagent employed as the color-forming co-reactants to form the ring-opened, colored compound may be disposed in the same or in separate elements. For example, the colorless di- or triarylmethane compound may be contained in one sheet and the electrophilic reagent in a second sheet, and color images formed by applying heat imagewise to the superposed sheets to effect contact between the co-reactants thereby initiating the coloration reaction in an imagewise pattern corresponding to said imagewise heating. Rather than two separate sheets, the colorless di- or triarylmethane compound and the electrophilic reagent may be employed in systems of the "self-containing" type utilizing a single sheet carrying the co-reactants in the same or in different layers. As above, color images are formed as a result of imagewise heating to bring the co-reactants into contact with each other and effect the coloration reaction in an imagewise pattern corresponding to the imagewise heating. In the production of multicolor images, two or more sets of co-reactants comprising the colorless di- or triarylmethane compound and electrophilic reagent usually are contained in a single sheet, i.e., carried on the same support.

In accordance with one embodiment of the present invention, a method of thermal imaging is provided which comprises heating imagewise at least one of (a) a substantially colorless di- or triarylmethane compound in a layer on a support, said di- or triarylmethane compound possessing on the meso carbon atom, i.e., on the methane carbon atom within its di- or triarylmethane structure an aryl group substituted on the carbon atom in the ortho position with a nucleophilic moiety which is ring-closed on the meso carbon atom and (b) an electrophilic reagent in a layer on the same or a separate support, which reagent upon contacting said colorless di- or triarylmethane compound undergoes a bimolecular nucleophilic substitution reaction with said nucleophilic moiety to form a colored, ring-opened di- or triarylmethane compound which is a new compound different from said (a), said imagewise heating effecting contact between said (a) and (b) to bring about said bimolecular reaction whereby said colored di- or triarylmethane compound is formed in an imagewise pattern corresponding to said imagewise heating.

A preferred method of thermal imaging in accordance with the present invention comprises heating imagewise a heat-sensitive element comprising a support carrying at least one layer of the above-denoted substantially colorless di- or triarylmethane compound, the above-denoted electrophilic reagent being disposed in the same or in a different layer carried on said support; bringing the colorless di- or triarylmethane compound and electrophilic reagent into contact with each other as a result of the imagewise heating to effect said bimolecular reaction, and forming as a result of said bimolecular reaction, an imagewise distribution of colored, ring-opened di- or triarylmethane compound in an imagewise distribution corresponding to said imagewise heating.

Colorless di- and triarylmethane compounds that may be used in the present invention are those represented by the formula

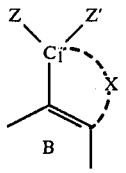

(I)

wherein ring B represents a carbocyclic aryl ring, e.g., of the benzene or naphthalene series or a hetrocyclic aryl ring, e.g., pyridine or pyrimidine; $C_1$ represents the meso carbon atom; X represents a nucleophilic moiety containing the atoms or groups of atoms necessary to complete a 5- or 6-membered ring; and Z and Z' taken individually represent the moieties to complete the auxochromophoric system of a diarylmethane or triarylmethane dye when said X moiety is ring opened and Z and Z' taken together represent the bridged moieties to complete the auxochromophoric system of a bridged triarylmethane dye when said X moiety is ring opened.

Preferably, said nucleophilic moiety contains a nitrogen atom as the nucleophilic atom and said nitrogen atom is bonded directly to said meso carbon atom. Particularly useful X moieties are those of the formula

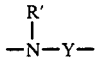

wherein R' is hydrogen, aryl, e.g., phenyl or alkyl usually containing 1 to 6 carbon atoms and Y is

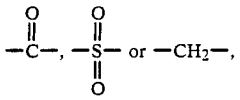

which moieties provide the lactam, sultam and benzylamine ring-closed groups such as those illustrated in the following formulae. In (Ic), R' is preferably other than hydrogen.

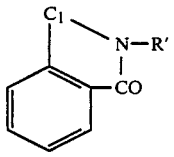

(Ia)

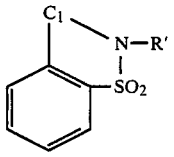

(Ib)

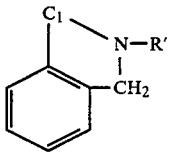

(Ic)

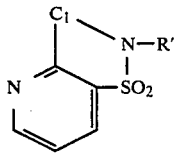

(Id)

In a preferred embodiment, B represents a benzene ring and Z and Z' taken individually represent the aryl moieties, the same or different, to complete the auxochromophoric system of a triarylmethane dye when said X moiety is ring opened and Z and Z' when taken together represent the bridged aryl moieties to complete the auxochromophoric system of a bridged triarylmethane dye when said X moiety is ring opened. Usually, at least one of Z and Z' whether taken individually or together possesses as an auxochromic substituent, a nitrogen, oxygen or sulfur atom or a group of atoms containing nitrogen, oxygen or sulfur.

In the triarylmethane compounds represented in formula I above, the aryl moieties Z and Z', when taken individually, may be the same or different and typically represent heterocyclic aryl groups containing nitrogen, oxygen or sulfur as the heterocyclic atom, particularly N-heterocyclic aryl groups such as julolidin-3-yl, indol-3-yl, pyrr-2-yl, carbazol-3-yl, and indolin-5-yl wherein the N atom of the indolyl, pyrryl, carbazolyl and indolinyl groups may be substituted with hydrogen or alkyl having 1 to 6 carbon atoms, or the aryl moieties Z and Z' typically may be carbocyclic aryl, particularly phenyl or naphthyl groups which include an appropriately positioned auxochromic substituent, i.e., an atom or group that produces an auxochromic effect, which substituent is usually positioned para to the meso carbon atom. Typically, Z and Z' when taken together represent aryl groups bridged by a heteroatom, such as, oxygen, sulfur or nitrogen to form, for example, 4H-chromeno [2,3-C] pyrazole and particularly represent carbocyclic aryl groups, such as, phenyl groups bridged with a heteroatom, preferably oxygen, sulfur or nitrogen substituted with hydrogen or an alkyl group having 1 to 6 carbon atoms to provide a xanthene, thioxanthene or an acridine dye, which dyes possess an auxochromic substituent(s) para to the meso carbon atom, i.e., in the 3-position or in the 3,6-positions or meta and para to the meso carbon atom, i.e., in the 3,7-positions.

In the diarylmethane compounds, one of Z and Z' may be heterocyclic aryl or carbocyclic aryl as discussed above and the other of Z and Z' may be, for example, phenoxy, thiophenoxy, alkoxy containing 1 to 20 carbon atoms, alkylthio containing 1 to 20 carbon atoms, —N,N—(disubstituted)amino wherein each said substituent may be alkyl containing 1 to 20 carbon atoms, carbocyclic aryl containing 6 to 12 carbon atoms, aralkyl containing 7 to 15 carbon atoms particularly phenyl- and naphthyl-substituted alkyl or alkaryl containing 7 to 15 carbon atoms particularly alkyl-substituted phenyl and naphthyl. Representative alkyl groups include methyl, butyl, hexyl and octadecyl and representative aryl groups include phenyl and naphthyl. Representative alkaryl groups include p-octylphenyl, o-methylnaphthyl and p-hexylphenyl, and representative aralkyl groups include phenethyl, benzyl and naphthylmethyl.

Examples of useful auxochromic substituents include $—OR_1$ wherein $R_1$ is hydrogen, alkyl usually having 1 to 6 carbon atoms, aralkyl usually having 7 to 15 carbon atoms, alkaryl usually having 7 to 15 carbon atoms or carbocyclic aryl usually having 6 to 12 carbon atoms; $—SR_2$ wherein $R_2$ has the same meaning given for $R_1$; $—NR_3R_4$ wherein $R_3$ and $R_4$ each represent hydrogen, alkyl usually having 1 to 6 carbon atoms, β-substituted ethyl, cycloalkyl usually having 5 to 7 carbon atoms, aralkyl usually having 7 to 15 carbon atoms, alkaryl usually having 7 to 15 carbon atoms or

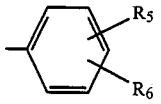

wherein $R_5$ and $R_6$ each are hydrogen, alkyl usually having 1 to 6 carbon atoms, halo such as chloro, bromo, fluoro and iodo, nitro, cyano, alkoxycarbonyl wherein said alkoxy has 1 to 6 carbon atoms, sulfonamido ($—NHSO_2R_0$), sulfamoyl ($—SO_2NHR_0$), sulfonyl ($—SO_2R_0$), acyl ($—COR_0$) or carbamyl ($—CONR_0$) wherein $R_0$ usually is alkyl having 1 to 6 carbon atoms, benzyl or phenyl and $R_3$ and $R_4$ taken together represent the atoms necessary to complete a heterocyclic ring usually piperidino, pyrrolidino, N-methylpiperidino, morpholino or

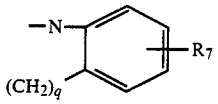

wherein q is an integer 2 to 5 and $R_7$ has the same meaning as $R_5$;

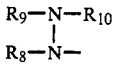

wherein $R_8$ and $R_9$ each are hydrogen, alkyl usually having 1 to 6 carbon atoms or

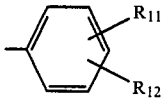

wherein $R_{11}$ and $R_{12}$ have the same meaning as $R_5$ and $R_6$ and $R_{10}$ is $—COR_{13}$, $—CSR_{13}$ or $—SO_2R_{13}$ wherein $R_{13}$ is hydrogen, alkyl usually having 1 to 6 carbon atoms, phenyl, $—NH_2$, $—NHR_{14}$, $—N(R_{14})_2$ or $—OR_{14}$ wherein $R_{14}$ is hydrogen, alkyl usually containing 1 to 6 carbon atoms or phenyl. Representative alkyl groups include methyl, ethyl, propyl, butyl and hexyl. Representative β-substituted ethyl groups include β-methoxymethoxyethyl and β-2'-tetrahydropyranyloxyethyl. Representative aralkyl groups include phenyl and naphthyl-substituted alkyl, such as, benzyl, phenethyl and naphthylmethyl and representative alkaryl groups include alkyl-substituted phenyl and naphthyl, such as, o-methylphenyl, o-methylnaphthyl and p-hexylphenyl. Representative carbocyclic aryl groups include phenyl and naphthyl and representative cycloalkyl groups include cyclopentyl, cyclohexyl and cycloheptyl. It will be appreciated that the auxochromic substituent(s) will be selected for a given diarylmethane, triarylmethane or bridged triarylmethane compound to provide the desired chromophore color upon opening of the X moiety and to achieve facile color formation. Representative alkyl groups for R' include methyl, ethyl, t-butyl and hexyl.

In addition to the auxochromic substituents, Z and/or Z' and/or the ring B of the ring-closing moiety may possess one or more additional substituents as may be desired that do not interfere with the intended utility for the dye. Typical substituents include carboxy; hydroxy; cyano; thiocyano; mercapto; sulfo; nitro; sulfonamido ($—NHSO_2R_0$); sulfamoyl ($—SO_2NHR_0$); sulfonyl ($—SO_2R_0$); acyl ($—COR_0$); carbamyl ($—CONR_0$); halomethyl such as trifluoromethyl; alkyl usually having 1 to 20 carbon atoms such as methyl, octyl, hexadecyl; alkoxy usually having 1 to 20 carbon atoms such as methoxy, ethoxy, propoxy and butoxy; alkoxycarbonyl having 1 to 6 carbon atoms such as methoxy- and ethoxycarbonyl; aralkyl usually having 7 to 15 carbon atoms, for example, phenyl or naphthyl-substituted alkyl such as benzyl, phenethyl and naphthylmethyl; alkaryl usually having 7 to 15 carbon atoms, for example, alkyl-substituted phenyl or naphthyl such as o-methylphenyl, o-methylnaphthyl and p-hexylphenyl; aralkyloxy usually having 7 to 15 carbon atoms, for example, phenyl or naphthyl-substituted alkoxy, such as benzyloxy, phenethyloxy and naphthylmethyloxy; aryloxy usually containing 6 to 12 carbon atoms such as phenoxy and naphthoxy; thioalkyl groups usually having 1 to 20 carbon atoms such as methylthio, ethylthio and hexylthio; thioaryl and thioaralkyl groups containing up to 15 carbon atoms such as phenylthio, naphthylthio, benzylthio and phenethylthio; halo such as chloro, bromo, fluoro and iodo; amino including mono- and disubstituted amino such as —$NR_8R_9$ wherein $R_8$ and $R_9$ each are hydrogen, alkyl usually having 1 to 20 carbon atoms, aralkyl usually having 7 to 15 carbon atoms, alkaryl usually having 7 to 15 carbon atoms, and carbocyclic aryl usually having 6 to 12 carbon atoms; and a fused substituent such as a fused benzene ring.

Preferred compounds of the present invention are those represented by the formula

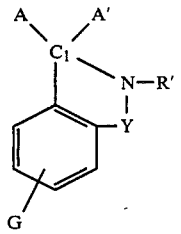

(II)

wherein $C_1$ represents the meso carbon atom; Y represents

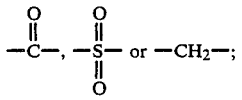

R′ is hydrogen, phenyl or alkyl usually containing 1 to 6 carbon atoms; G is hydrogen, alkyl having 1 to 6 carbon atoms, alkoxy having 1 to carbon atoms, alkoxycarbonyl having 1 to 6 carbon atoms, carboxy, cyano, thiocyano, nitro, sulfo, sulfonamido, sulfamoyl, sulfonyl, acyl, carbamyl, halo, —OR wherein R is hydrogen, alkyl having 1 to 6 carbon atoms, benzyl or phenyl, —$SR^0$ wherein $R^0$ has the same meaning as R or —$NR^5R^6$ wherein $R^5$ and $R^6$ each are hydrogen, alkyl having 1 to 6 carbon atoms, β-substituted ethyl, benzyl or phenyl; A and A′, the same or different, are selected from phenyl substituted in the 4-position with —$OR^1$ wherein $R^1$ has the same meaning as R, —$SR^2$ wherein $R^2$ has the same meaning as R or —$NR^5R^6$ wherein $R^5$ and $R^6$ have the same meaning given above and substituted in the 2-, 3-, 5- and 6-positions with hydrogen, alkyl having 1 to 6 carbon atoms, alkoxy having 1 to 6 carbon atoms or chloro or substituted in the 5- and 6-positions with a fused benzene ring; indol-3-yl substitued in the 1 and 2 positions with hydrogen, alkyl having 1 to 6 carbon atoms, benzyl or phenyl; pyrr-2-yl substituted in the 1-position with hydrogen, alkyl having 1 to 6 carbon atoms, benzyl or phenyl; and carbazol-3-yl substituted in the 9-position with hydrogen, alkyl having 1 to 6 carbon atoms, benzyl or phenyl; and A and A′ taken together represent phenyl groups bridged by a heteroatom selected from oxygen, sulfur and nitrogen substituted with hydrogen or alkyl having 1 to 6 carbon atoms to form xanthene, thioxanthene or acridine (a) substituted in the 3- and 6-positions with a group, the same or different, selected from —$OR^3$ wherein $R^3$ has the same meaning as R, —$SR^4$ wherein $R^4$ has the same meaning as R, —$NR^7R^8$ wherein $R^7$ is hydrogen or alkyl having 1 to 6 carbon atoms and $R^8$ is alkyl having 1 to 6 carbon atoms, benzyl or

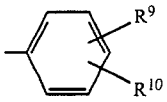

wherein $R^9$ and $R^{10}$ each are hydrogen, alkyl usually having 1 to 6 carbon atoms, alkoxy having 1 to 6 carbon atoms, chloro, nitro, cyano, alkoxycarbonyl wherein said alkoxy has 1 to 6 carbon atoms, sulfonamido, sulfamoyl, sulfonyl, acyl, or carbamyl and $R^9$ and $R^{10}$ taken together represent indolino and

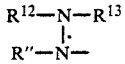

wherein $R^{11}$ and $R^{12}$ each are hydrogen, alkyl having 1 to 6 carbon atoms or

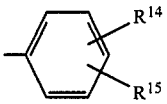

wherein $R^{14}$ and $R^{15}$ have the same as $R^9$ and $R^{10}$ and $R^{13}$ is —$COR^{16}$ wherein $R^{16}$ is hydrogen, alkyl having 1 to 6 carbon atoms or phenyl and substituted in the 1-, 2-, 4-, 5-, 7- and 8-positions with hydrogen, alkyl having 1 to 6 carbon atoms, alkoxy having 1 to 6 carbon atoms or chloro or (b) substituted in the 3-position with —$NR^{17}R^{18}$ wherein $R^{17}$ is hydrogen, alkyl having 1 to 6 carbon atoms, cycloalkyl having 5 to 7 carbon atoms, benzyl or phenyl and $R^{18}$ is alkyl having 1 to 6 carbon atoms, cycloalkyl having 5 to 7 carbon atoms, benzyl or phenyl and $R^{17}$ and $R^{18}$ taken together represent piperidino, pyrrolidino, N-methylpiperidino or indolino and (1) substituted in the 7- and 8-positions with a fused benzene ring or (2) substituted in the 7-position with hydrogen, —$NR^{17}R^{18}$ wherein $R^{17}$ and $R^{18}$ have the same meaning given above, alkyl having 1 to 6 carbon atoms, alkoxy having 1 to 6 carbon atoms or chloro and substituted in the 1-, 2-, 4-, 5-, 6- and 8-positions with hydrogen, alkyl having 1 to 6 carbon atoms, alkoxy having 1 to 6 carbon atoms or chloro.

Various diarylmethane and triarylmethane dyes including bridged triarylmethanes possessing these ring-closed moieties or capable of being derivatized with these moieties have been disclosed in the art. For example, various lactones and lactams have been described in Venkataraman, K., The Chemistry of Synthetic Dyes, Academic Press, Inc., New York, 1952, pp. 705–760 and 1111, in Beilstein's Handbuch der Organischem Chemie, vol. 27, p. 431 and p. 534, in Dutt, J. Chem. Soc. 121, p. 2389 (1922), in French Pat. No. 1,519,027, in German Pat. Nos. 100,779 and 100,780 and in U.S. Pat. Nos. 3,491,111, 3,491,112, 3,491,116, 3,509,173, 3,509,174, 3,514,310, 3,514,311, 3,775,424, 3,853,869, 3,872,046, 3,931,227, 3,959,571, 4,341,403, 4,304,833, 4,535,172 and 4,535,348. The preparation of lactams by reacting the ethylester derived from a lactone with an amine in a conventional manner also is described in U.S. Pat. No. 4,316,950. Also, certain N-acylated lactams, sultams, and benzylamines that undergo cleavage to the corresponding —NH or —Nalkyl ring-closed triarylmethane compound by treatment with alkali are disclosed in U.S. Pat. Nos. 4,139,381, 4,178,446, 4,195,180, 4,259,493, 4,304,833, 4,316,950 and 4,345,017. The syntheses described in these patents also may be employed to prepare the —NH and —Nalkyl lactam, sultam and benzylamine compounds directly by omitting or removing the hydroxyl protecting groups from the intermediates.

The electrophilic reagent may comprise blocked and polymeric reagents as well as simple molecules. Like the di- or triarylmethane compound, the electrophilic reagent also should be substantially colorless, and the particular electrophilic reagent selected will depend upon the X moiety of the di- or triarylmethane. The suitability of the reagent for effecting the bimolecular reaction may be readily determined empirically by heating the selected di- or triarylmethane compound and the selected electrophilic reagent at a temperature of about 100°-200° C. to observe the degree of color formation. Preferably, full coloration to the new colored compound should be complete within a few seconds.

Preferably, the electrophilic reagent is an acylating agent for introducing the acyl radical of a carboxylic, sulfonic or phosphoric acid onto the N atom of said nucleophilic moiety, i.e., —CO—E, —$SO_2$—E and —PO—$(OE)_2$ wherein E is alkyl or aryl, which alkyl or aryl may be substituted or unsubtituted. Examples of useful acylating agents include anhydrides, acid chlorides, isocyanates, ketenes and disubstitutedcarbodiimides.

The electrophilic reagent may be encapsulated, disposed in a separate layer or sheet or otherwise physically separated from the di- or triarylmethane compound to prevent premature reaction and enhance image stability. To prevent undesired reaction between the di- or triarylmethane compound and the electrophilic reagent, it is preferred to employ an electrophilic reagent blocked with a thermally labile group, that is, a group which is released upon heating at a predetermined temperature so that the electrophilic reagent will be available for reaction at elevated temperatures but not at ambient temperatures. The use of a blocked electrophilic reagent is especially desirable where the co-reactants are in the same or in adjacent layers.

Particularly useful blocked electrophilic reagents are those wherein the blocking group upon being released facilitates the acylation reaction, for example, blocked isocyanates and blocked ketenes such as the compounds L—CO—NH—Ar, ArO—CO—$CH_2$—CO—L, AlkO—CO—$CH_2$—CO—L and Ar—$SO_2$—$CH_2$—CO—L, wherein Ar is aryl, e.g., phenyl or substituted phenyl and Alk is alkyl usually containing 1 to 6 carbon atoms and L is a blocking group that is released upon heating. L may be a phenolate group, a phenolate substituted with a carboxyl group or

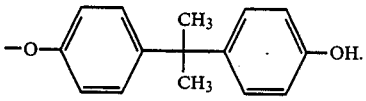

As noted above "electrophilic reagent" as used herein is intended to include both blocked and unblocked reagents.

In producing images according to the present invention, the way in which the heat is applied or induced imagewise may be realized in a variety of ways, for example, by direct application of heat using a thermal printing head or thermal recording pen or by conduction from heated image-markings of an original using conventional thermographic copying techniques. Preferably, selective heating is produced in the image-forming layers by the conversion of electromagnetic radiation into heat and preferably, the light source is a laser beam emitting source such as a gas laser or semiconductor laser diode. The use of a laser beam is not only well suited for recording in a scanning mode but by utilizing a highly concentrated beam, photo-energy can be concentrated in a small area so that it is possible to record at high speed and high density. Also, it is a convenient way to record data as a heat pattern in response to transmitted signals such as digitized information and a convenient way of preparing multicolor images by employing a plurality of laser beam sources that emit laser beams of different wavelengths.

In the latter embodiment an infra-red absorbing substance is employed for converting infra-red radiation into heat which is transferred to the colorless di- or triarylmethane compound and/or electrophilic reagent for effecting imagewise contact of the co-reactants and thus, effecting the bimolecular reaction to form color imagewise. Since the electrophilic reagent rather than the di- or triarylmethane compound is usually selected for deblocking and/or melting at a certain temperature or temperature range for effecting contact between the co-reactants, the infra-red absorber ordinarily is disposed in the layer containing the electrophilic reagent or in an adjacent layer so that it is in heat-conductive contact therewith. Preferably, the infra-red absorber is an organic compound, such as, a cyanine, merocyanine or thiopyrylium dye and preferably, it is substantially non-absorbing in the visible region of the electromagnetic spectrum so that it will not add any substantial amount of color to the $D_{min}$ areas, i.e., the highlight areas of the image.

In the production of multicolor images, infra-red absorbers may be selected that absorb radiation at different predetermined wavelengths above 700 nm, which wavelengths are usually at least about 60 nm apart, so that each set of color-forming co-reactants may be exposed separately and independently of the others by using infra-red radiation at the particular wavelenghs selectively absorbed by the respective infra-red absorbers. As an illustration, the layer(s) containing the co-reactants for forming yellow, magenta and cyan may have infra-red absorbers associated therewith that absorb radiation at 760 nm, 820 nm and 1100 nm, respectively, and may be addressed by laser beam sources, for example, infra-red laser diodes emitting laser beams at these respective wavelengths so that the yellow imaging layer can be exposed independently of the magenta and cyan imaging layers, the magenta imaging layer can be exposed independently of the yellow and cyan imaging layers, and the cyan imaging layer can be exposed independently of the yellow and magenta imaging layers. While each set of co-reactants may be exposed in a separate scan, it is usually preferred to expose all of them simultaneously in a single scan using multiple laser beam sources of the appropriate wavelengths. Rather than using superimposed imaging layers, the co-reactants and associated infra-red absorbers may be arranged in an array of side-by-side dots or stripes in a single recording layer.

In a further embodiment, multicolor images may be produced using the same infra-red absorbing compound in association with each of two or more sets of co-reactants and exposing each by controlling the depth of focussing of the laser beam. In this embodiment, the concentration of infra-red absorber is adjusted so that each of the infra-red absorbing layers absorb approximately the same amount of laser beam energy. For example, where there are three infra-red absorbing layers, each layer would absorb about one-third of the laser beam energy. It will be appreciated that controlling the focussing depth to address each layer separately may be carried out in combination with the previous embodiment of using infra-red absorbers that selectively absorb at different wavelengths in which instance the concentration of infra-red absorber would not have to be adjusted for the laser beam energy since the first infra-red dye would not absorb any substantial amount of radiation at the absorption peaks of the second and third dyes and so forth.

Where imagewise heating is induced by converting light to heat as decribed above, the heat-sensitive element comprising the di- or triarylmethane compound-/electrophilic reagent for providing either monochrome or multicolor images may be heated prior to or during imagewise heating. This may be achieved using a heating platen or heated drum or by employing an additional laser beam source for heating the element while it is being exposed imagewise.

As noted above, the di- or triarylmethane compound and the electrophilic reagent may be carried on the same or on separate supports. In the production of multicolor images, the di- or triarylmethane compound and its associated electrophilic reagent are carried on the same support, and while the co-reactants may be in the same layer, they are preferably contained in separate layers, usually adjacent layers. In addition to the co-reactants, the elements used in the subject thermal imaging system may contain additional layers, for example, a subbing layer to improve adhesion to the support, interlayers for thermally and chemically isolating the respective di- or triarylmethane compound/electrophilic reagent layers from each other, infra-red absorbing layers as discussed above, anti-static layers, an anti-abrasive topcoat layer which also may function as a UV protecting layer but including an ultraviolet absorber therein or other auxiliary layers. For example, an electroconductive layer may be included and imagewise formation effected by heat energy in response to an electrical signal.

The di- or triarylmethane compounds are selected to give the desired color or combination of colors, and for multicolor images, the compounds selected may comprise the additive primary colors red, green and blue, the subtractive primaries yellow, magenta and cyan or other combinations of colors, which combinations may additionally include black. As noted previously, the compounds generally are selected to give the substractive colors cyan, magenta and yellow as commonly employed in photographic processes to provide full natural color. Also, a black image may be obtained by selecting a triarylmethane compound that forms a black dye.

The support employed may be transparent or opaque and may be any material that retains its dimensional stability at the temperature used for image formation. Suitable supports include paper, paper coated with a resin or pigment, such as, calcium carbonate or calcined clay, synthetic papers or plastic films, such as polyethylene, polypropylene, polycarbonate, cellulose acetate, polyethylene terephthalate and polystyrene. Where the di- or triarylmethane compound and electrophilic reagent are carried on separate supports that are retained together after image formation, one of the supports should be transparent to permit viewing of the image.

Usually the layer of di- or triarylmethane compound and electrophilic reagent contain a binder and are formed by combining the reactant(s) and binder in a common solvent, applying a layer of the composition to the support and then drying. Rather than a solution coating, the layer may be applied as a dispersion or an emulsion. The coating composition may contain dispersing agents, plasticizers, defoaming agents, coating aids and materials such as waxes to prevent sticking where thermal recording beads or thermal pens are used to apply the imagewise pattern of heat. In forming these and other layers, temperatures should be maintained below levels that will initiate the bimolecular reaction so that the di- or triarylmethane compound will not become prematurely colored.

Any of the binders commonly employed in heat-sensitive recording elements may be employed provided that the binder selected is inert, i.e., does not have any adverse effect on or react with the di- or triarylmethane compound or the electrophilic reagent incorporated therein. Also, the binder should be heat-stable at the temperatures encountered during image formation and it should be transparent so that it does not interfere with viewing of the color image. Where electromagnetic radiation is employed to induce imagewise heating, the binder also should transmit the light intended to initiate image formation. Examples of binders that may be used include polyvinyl pyrrolidone, cellulose acetate butyrate, copolymers of styrene and butadiene, polymethyl methacrylate, copolymers of methyl and ethyl acrylate, polyvinyl acetate and polyvinyl chloride.

The following examples are given to further illustrate the present invention and are not intended to limit the scope thereof.

EXAMPLE 1

The colorless triarylmethane compound having the formula

Compound A

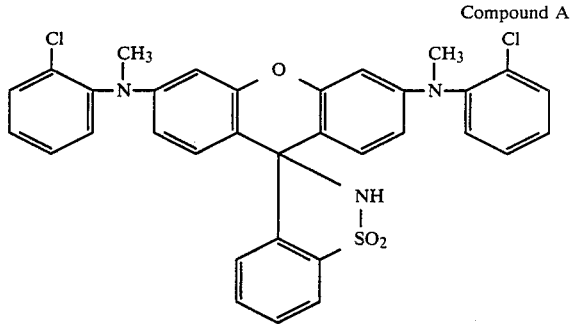

was added to a dispersion of 8% by weight polyvinylpyrrolidone in methanol, and the mixture was coated on a glass plate and dried to give a colorless coating. Solid phthalic anhydride was pressed onto a portion of the dried coating and the glass plate heated to just above the melting point of the phthalic anhydride (approximately 131° C.). The melt area, i.e., the portion of the coating where the anhydride had been applied became deep magenta while the rest of the coating remained colorless.

The presumed structure for the new magenta compound (M/e+ 745) obtained by the reaction between the phthalic anhydride and Compound A is set out below.

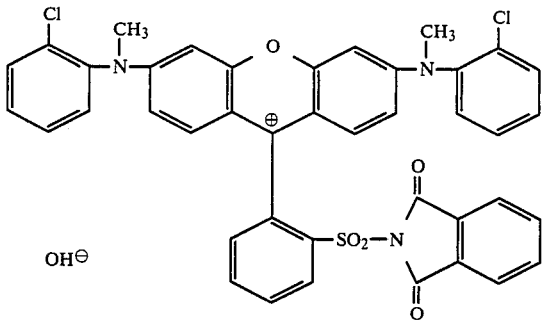

EXAMPLE 2

The procedure of Example 1 was repeated except that the colorless triarylmethane compound employed had the formula Compound B

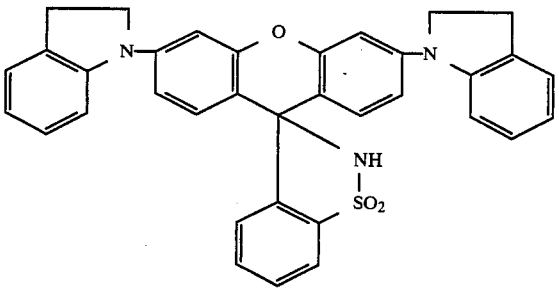

It was found upon heating that the melt area where the phthalic anhydride had been applied to the colorless coating of triarylmethane compound became cyan and the rest of the coating remained colorless.

The presumed structure for the new cyan compound (M/e+ 701) formed by the reaction between the phthalic anhydride and Compound B is set out below.

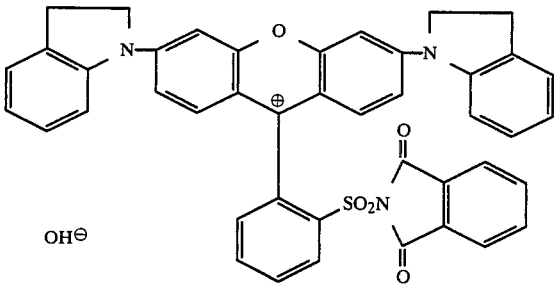

EXAMPLE 3

The colorless triarylmethane compound designated Compound A in Example 1 above was added to a dispersion of polyvinylpyrrolidone in tetrahydrofuran and the resulting mixture coated on a glass slide and dried to give a colorless coating. The layer of triarylmethane compound was then overcoated with a solution of a blocked isocyanate in tetrahydrofuran and polyvinylpyrrolidone which also gave a colorless clear coating after drying. The blocked isocyanate employed had the formula Compound (i)

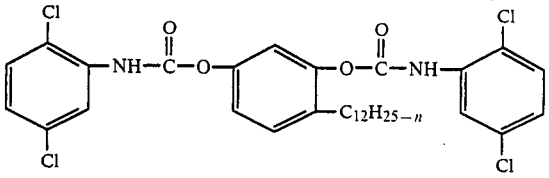

When a portion of the glass slide was heated to a temperature between about 150° and 200° C., a magenta color was formed.

In a further experiment, Compound A was mixed with approximately an equivalent amount of the above-denoted blocked isocyanate and the mixture placed in a capillary tube. Upon heating in an oil bath, melting occured at about 130° C. (pink color formed) and color gradually formed at higher temperatures—deep magenta at about 140° to 170° C. and very deep magenta at about 210° C. The color remained up to a temperature of about 300° C. before decomposition occurred.

The presumed structure for the new magenta compound formed by the reaction between Compound A and the thermally liberated isocyanate

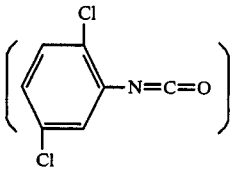

is set out below

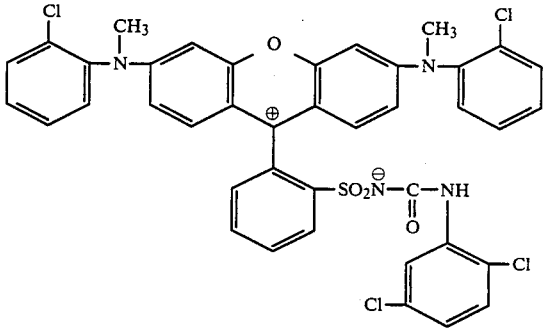

M/e+ 802

The blocked isocyanate designated Compound (i) was prepared as follows:

4-Dodecyl resorcinol (1.0 g, 3.6 mmol), 2,5-dichlorophenyl isocyanate (1.45 g, 7.7 mmol) and potassium carbonate (0.1 g) were mixed together and refluxed in methylene chloride. After about 15 minutes of refluxing, the reaction was complete and after standing for one hour at room temperature, solids formed. The reaction solution was diluted with methylene chloride, warmed, filtered through Celite, concentrated to 50 cc and cooled. Filtering of the cooled solution gave the title compound as a white solid.

EXAMPLE 4

A tetrahydrofuran solution of the blocked isocyanate designated Compound (i) in Example 3 above was mixed with a solution of polyvinylpyrrolidone in acetonitrile and the mixture coated on a glass slide and dried to give a colorless coating. A tetrahydrofuran solution of Compound A was mixed with a solution of polyvinylpyrrolidone in acetonitrile, and this mixture was coated over the gelatin layer of a gelatin subcoated polyethylene terephthalate support to give a colorless coating after drying. The coated elements were superposed with the coated sides face-to-face, and a clean glass slide was placed against the polyethylene terephthalate to provide a glass "sandwich". Upon heating the "sandwich" at a temperature between about 180° and 200° C., a magenta color formed.

EXAMPLE 5

Example 4 was repeated except that the blocked isocyanate-polyvinylpyrrolidone mixture was coated on polyvinylpropylene, and the mixture of Compound A and polyvinylpyrrolidone was coated on glass. After placing a clean glass slide against the polyvinylpropylene side of the superposed elements, the "sandwich" was heated at a temperature between about 180° and 200° C. A deep magenta color formed.

In addition to the above, Compound A was mixed with the electrophilic reagents denoted below and the mixtures heated at a temperature between about 150° and 220° C. The presumed structures for the new magenta colored, ring-opened structures also are set out below.

| | Electrophilic Reagent | New Ring-Opened Product |
|---|---|---|
| (1) | 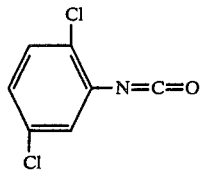 | 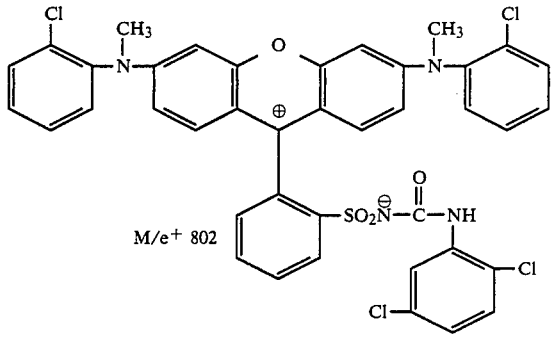 M/e+ 802 |
| (2) | 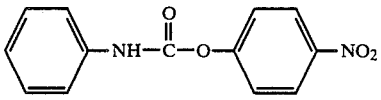 | 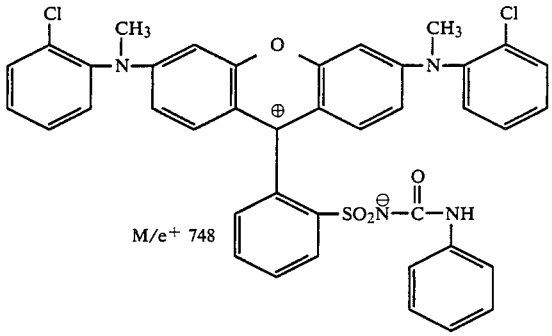 M/e+ 748 |
| (3) | 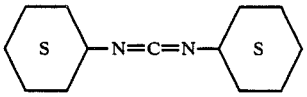 | 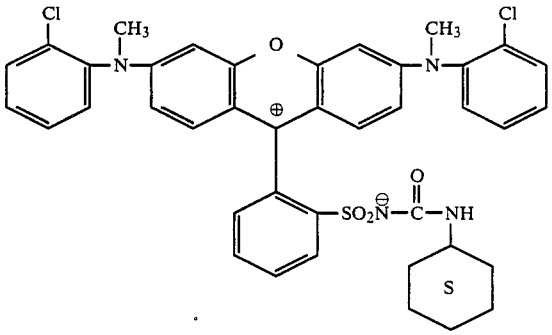 |

-continued
| Electrophilic Reagent | New Ring-Opened Product |
|---|---|
| (4) 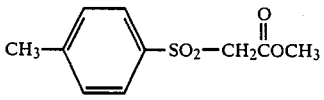 | 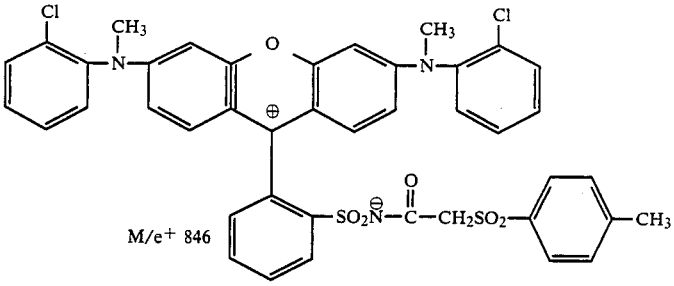 M/e+ 846 |
| (5) 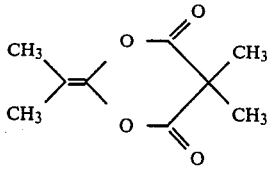 | 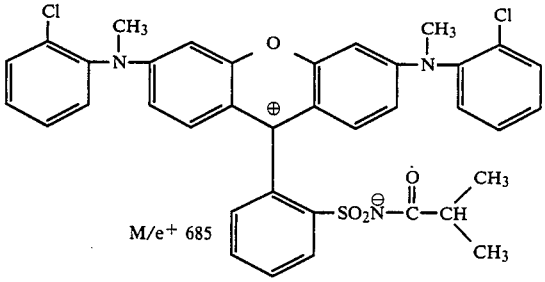 M/e+ 685 |
| (6) 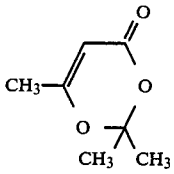 | 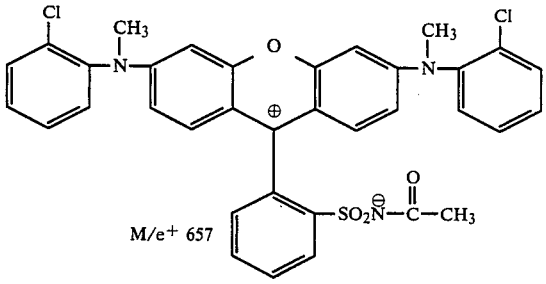 M/e+ 657 |
| (7) 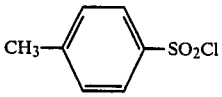 | 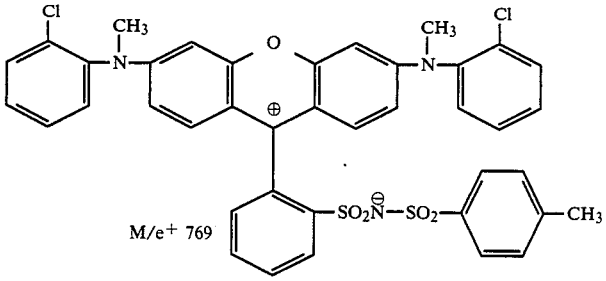 M/e+ 769 |
Compound C having the formula
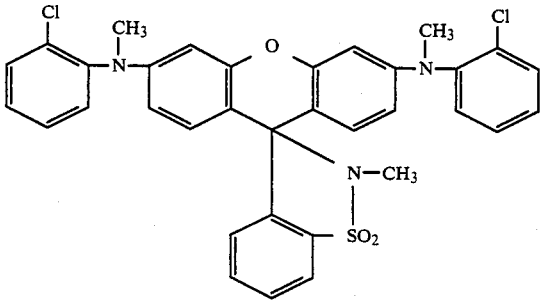
Compound D having the formula -continued
| Electrophilic Reagent | New Ring-Opened Product |
|---|---|
| 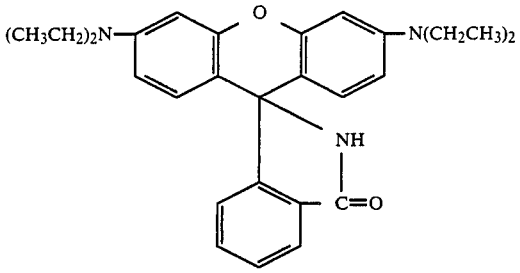 | |
| Compound E having the formula 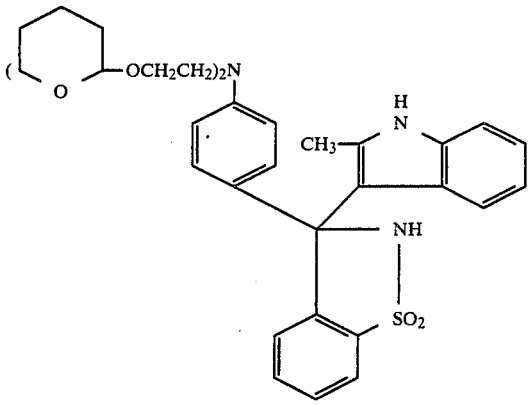 | |
also were heated at a temperature of between about 150° and 220° C. in admixture with tosyl chloride, phthalic anhydride and phenylisocyanate, respectively, to give the presumed structures indicated below.
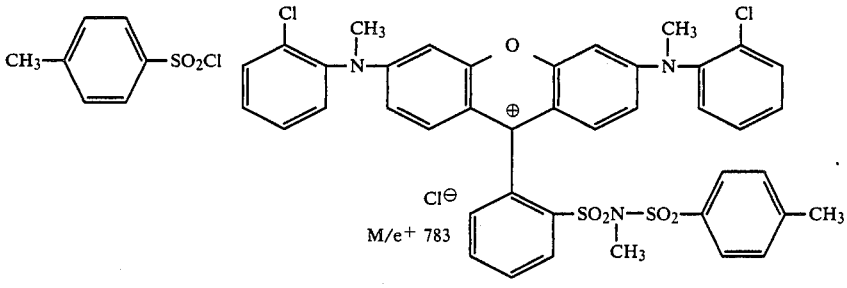
(9)
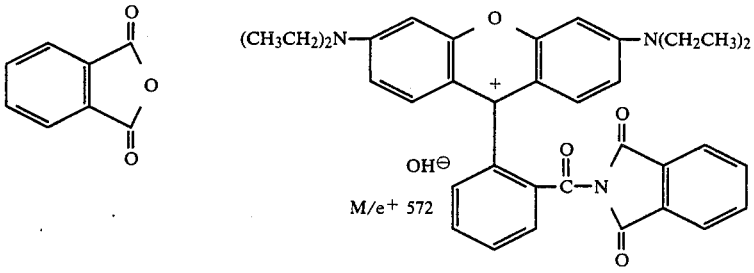
(10)

-continued
(11)
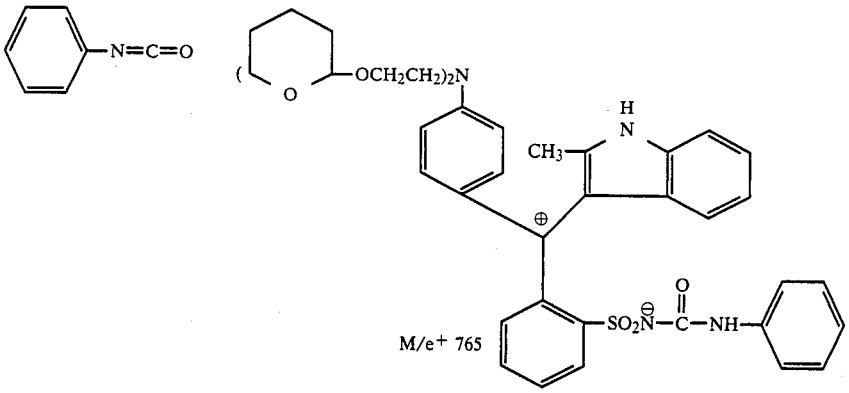
Illustrative of other compounds that may be used in the present invention are those of the following formulae:
(a)
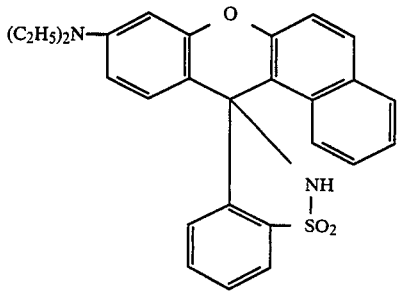
(b)
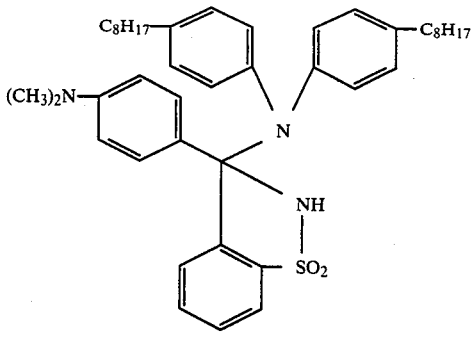
(c)
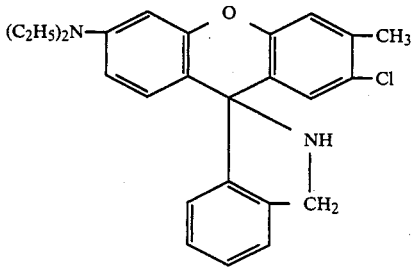
-continued
(d)
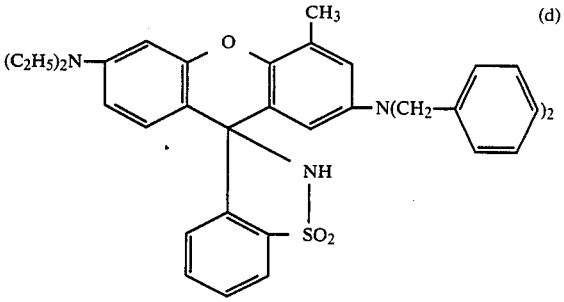
(e)
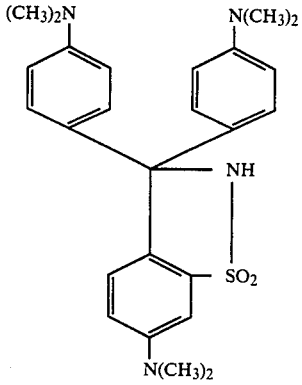
(f)
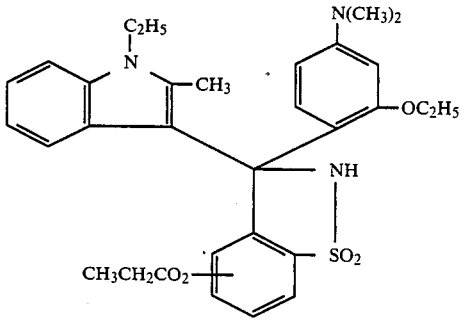

-continued

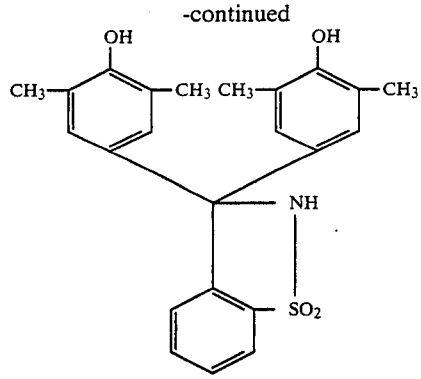

(g)

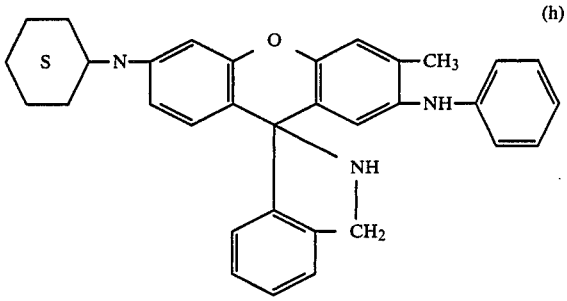

(h)

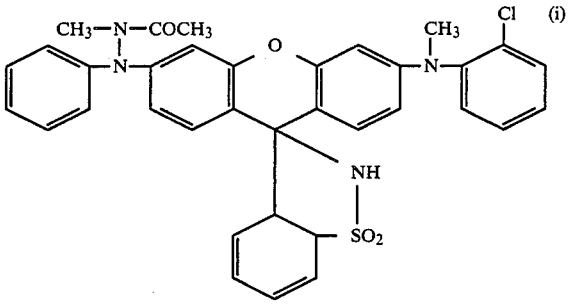

(i)

The blocked ketenes used above are known and others have been described in H. Bestian and D. Gunther, Angew. Chem. Internat. Edit., Vol. 2 (1963), pp. 608–13 and in R. F. Pratt and T. C. Bruice, J. Amer. Chem. Soc., 92:20, Oct. 7, 1970, pp. 5956–64. The blocked isocyanates can be prepared in a conventional manner as described previously and other classes of blocked isocyanates may be prepared as described in W. H. Daly and H. J. Holle, J. Org. Chem., Vol. 39, No. 11, 1974, pp. 1597–1600.

As discussed above, the formation of color is achieved according to the present invention by a bimolecular reaction between a colorless di- or triarylmethane compound possessing a ring-closed nucleophilic moiety within its structure and an electrophilic reagent that reacts with the nucleophilic moiety of the di- or triarylmethane compound to form a ring-opened product which is colored and different from the colorless reactant. As can be seen from the results presented above, color was formed upon heating the coated samples of Examples 1 to 5 and upon heating the above-denoted mixtures of colorless triarylmethane compounds and electrophilic reagents to provide the ring-opened colored compounds.

Since certain changes may be made in the herein described subject matter without departing from the scope of the invention herein involved, it is intended that all matter contained in the above description and examples be interpreted as illustrative and not in a limiting sense.

What is claimed is:

1. A heat-sensitive element comprising a support carrying as color-forming co-reactants in the same or different layers (a) a subtantially colorless di- or triarylmethane compound possessing on the meso carbon atom within its di- or triarylmethane structure an aryl group substituted in the ortho position with a nucleophilic moiety which is ring-closed on the meso carbon atom and (b) an electrophilic reagent which upon heating and contacting said di- or triarylmethane compound undergoes a bimolecular nucleophilic substitution reaction with said nucleophilic moiety to form a colored, ring-opened di- or triarylmethane compound.

2. A heat-sensitive element as defined in claim 1 wherein an infra-red absorber is associated with at least one of said color-forming co-reactants (a) and (b) for absorbing radiation at wavelengths above 700 nm and transferring said absorbed radiation as heat to said reactants.

3. A heat-sensitive element as defined in claim 1 wherein a black compound is formed upon reaction of said (b) with said (a).

4. A heat-sensitive element as defined in claim 1 wherein said element comprises at least two sets of said color-forming co-reactants (a) and (b).

5. A heat-sensitive element as defined in claim 3 wherein an infra-red absorber is associated with each set of said color-forming co-reactants for absorbing radiation at wavelengths above 700 nm and transferring said absorbed radiation as heat to at least one of said co-reactants of each said set.

6. A heat-sensitive element as defined in claim 5 wherein said infra-red absorbers selectively absorb radiation at different predetermined wavelengths above 700 nm.

7. A heat-sensitive element as defined in claim 5 wherein said infra-red absorbers absorb radiation at the same wavelength above 700 nm.

8. A heat-sensitive element as defined in claim 5 which additionally includes a thermal isolation layer between adjacent sets of said color-forming reactants.

9. A heat-sensitive element as defined in claim 8 wherein three sets of said color-forming co-reactants are carried on said support for forming a cyan image, a magenta image and a yellow image, respectively.

10. A method of thermal imaging which comprises heating imagewise as color-forming co-reactants at least one of (a) a substantially colorless di- or triarylmethane compound in a layer on a support, said di- or triarylmethane compound possessing on the meso carbon atom within its di- or triarylmethane structure an aryl group substituted in the ortho position with a nucleophilic moiety which is ring-closed on the meso carbon atom and (b) an electrophilic reagent in a layer on the same or a separate support, which reagent upon contacting said colorless di- or triarylmethane compound undergoes a bimolecular nucleophilic substitution reaction with said nucleophilic moiety to form a colored, ring-opened di- or triarylmethane compound different from said (a), said imagewise heating effecting contact between said (a) and (b) to bring about said bimolecular reaction whereby said colored di- or triarylmethane compound is formed in an imagewise pattern corresponding to said imagewise heating.

11. A method of thermal imaging as defined in claim 10 wherein an infra-red absorber is associated with at least one of said color-forming co-reactants (a) and (b) for absorbing radiation at wavelengths above 700 nm and transferring said absorbed radiation as heat to said reactant, said imagewise heating being effected by imagewise exposure to infra-red radiation at a wavelength strongly absorbed by said infra-red absorber.

12. A method of thermal imaging as defined in claim 10 wherein said color-forming co-reactants (a) and (b) are carried on the same support in the same or different layers.

13. A method of thermal imaging as defined in claim 12 wherein at least two sets of said color-forming co-reactants (a) and (b) are carried on said support.

14. A method of thermal imaging as defined in claim 13 which additionally includes a thermal isolation layer between adjacent sets of said color-forming co-reactants.

15. A method of thermal imaging as defined in claim 13 wherein said infra-red absorber is associated with each set of said color-forming co-reactants for absorbing radiation at wavelengths above 700 nm and transferring said absorbed radiation as heat to at least one of said (a) and (b) of each set of co-reactants, said infra-red absorbers associated with each set of co-reactants selectively absorbing infra-red radiation at different predetermined wavelengths above 700 nm, said imagewise heating being effected by imagewise exposure to a plurality of laser beam sources emitting infra-red radiation at the respective wavelengths selectively absorbed by said infra-red absorbers.

16. A method of thermal imaging as defined in claim 13 wherein an infra-red absorber is associated with each set of color-forming co-reactants for absorbing radiation at wavelengths above 700 nm and transferring said absorbed radiation as heat to at least one of said (a) and (b) of each set of co-reactants, said infra-red absorbers associated with each set of co-reactants absorbing infra-red radiation at the same or at different predetermined wavelengths above 700 nm, said imagewise heating being effected by adjusting the depth of focus of a laser beam source emitting radiation at the wavelength absorbed by said infra-red absorber.

* * * * *